US009273531B2

(12) United States Patent
Tan et al.

(10) Patent No.: US 9,273,531 B2
(45) Date of Patent: Mar. 1, 2016

(54) ORIENTATION ADAPTER FOR USE WITH A TUBING HANGER

(71) Applicant: GE Oil & Gas UK Limited (Aberdeen) (UK and Northern Ireland), Houston, TX (US)

(72) Inventors: Chin Choy Tan, Singapore (SG); Haw Keat Lim, Singapore (SG); Farandy Angesti Liong, Singapore (SG)

(73) Assignee: GE Oil & Gas UK Limited, Houston, TX (US)

( * ) Notice: Subject to any disclaimer, the term of this patent is extended or adjusted under 35 U.S.C. 154(b) by 145 days.

(21) Appl. No.: 14/098,590

(22) Filed: Dec. 6, 2013

(65) Prior Publication Data

US 2015/0159458 A1 Jun. 11, 2015

(51) Int. Cl.

| | |
|---|---|
| ***E21B 33/043*** | (2006.01) |
| ***E21B 33/04*** | (2006.01) |
| ***E21B 33/047*** | (2006.01) |

(52) U.S. Cl.

CPC ..... *E21B 33/0422* (2013.01); *E21B 33/043* (2013.01); *E21B 33/0407* (2013.01); *E21B 33/047* (2013.01)

(58) Field of Classification Search

CPC E21B 33/043; E21B 33/0407; E21B 33/0422
USPC ..... 166/348, 341, 368, 382
See application file for complete search history.

(56) References Cited

U.S. PATENT DOCUMENTS

| | | | | |
|---|---|---|---|---|
| 3,638,732 | A * | 2/1972 | Huntsinger et al. | 166/379 |
| 5,503,230 | A * | 4/1996 | Osborne et al. | 166/344 |
| 5,544,707 | A * | 8/1996 | Hopper et al. | 166/382 |
| 5,975,210 | A * | 11/1999 | Wilkins et al. | 166/341 |
| 6,810,954 | B2 * | 11/2004 | Garrett et al. | 166/77.51 |
| 7,063,160 | B2 | 6/2006 | Fenton et al. | |
| 7,762,338 | B2 | 7/2010 | Fenton et al. | |
| 7,770,650 | B2 * | 8/2010 | Young et al. | 166/344 |
| 8,061,428 | B2 | 11/2011 | Fenton et al. | |
| 8,157,015 | B2 * | 4/2012 | Voss et al. | 166/368 |
| 8,240,389 | B2 * | 8/2012 | Christie | 166/368 |
| 2003/0094284 | A1 | 5/2003 | Fenton et al. | |
| 2003/0121667 | A1 | 7/2003 | Massie et al. | |
| 2003/0226666 | A1 | 12/2003 | Fenton et al. | |
| 2011/0017467 | A1 * | 1/2011 | June | 166/368 |
| 2013/0126181 | A1 * | 5/2013 | Bell | 166/348 |

OTHER PUBLICATIONS

PCT Search Report and Written Opinion issued in connection with corresponding PCT Application No. PCT/US2014/068340 on Jul. 14, 2015.

* cited by examiner

*Primary Examiner* — Matthew R Buck

(74) *Attorney, Agent, or Firm* — Bracewell & Giuliani LLP

(57) ABSTRACT

A subsea wellhead assembly includes a production tree and a tubing hanger assembly having a tubing hanger and an orientation adapter. A passage is formed through a side wall of the orientation adapter for porting communication from within a main bore of the wellhead assembly. When the tubing hanger assembly lands in the wellhead, a key on the orientation adapter engages a helical profile on an inner surface of the main bore and rotates the orientation adapter so that the passage registers with a passage in the tree. Fluid and electricity communicates through the registered passages. Examples of connectors between the respective passages include spheriseal connectors and electrical wet connects.

12 Claims, 3 Drawing Sheets

ORIENTATION ADAPTER FOR USE WITH A TUBING HANGER

BACKGROUND

1. Field of Invention

The invention relates generally to a wellhead assembly for use subsea, and having wellhead components that align during assembly to register passages in the respective components.

2. Description of Prior Art

Subsea wellbores are formed from the seafloor into subterranean formations lying underneath. Systems for producing oil and gas from subsea wellbores typically include a subsea wellhead assembly set over an opening to the wellbore. Subsea wellheads usually include a high pressure wellhead housing supported in a low pressure wellhead housing and secured to conductor casing that extends downward past the wellbore opening. Wells are generally lined with one or more casing strings coaxially inserted through, and significantly deeper than, the conductor casing. The casing strings are typically suspended from casing hangers landed in the wellhead housing. One or more tubing strings are usually provided within the innermost casing string; that among other things are used for conveying well fluid produced from the underlying formations. The produced well fluid is typically controlled by a production tree mounted on the upper end of the wellhead housing. The production tree, which is a large, heavy assembly, is generally equipped with a number of valves and controls mounted thereon. One of the largest challenges when running and installing tubing hangers in wellheads is ensuring correct orientation to ensure proper communication with downhole equipment, and to prevent damaging the couplers and seals between the production tree and tubing hanger during installation of the production tree. Several systems have been previously employed to achieve orientation, which consume valuable rig resources.

Some subsea wellhead assemblies include a tubing hanger spool that lands on an upper end of the high pressure housing. The tubing hanger is supported within the tubing hanger spool, and can be landed therein prior to or after the production tree mounts to the upper end of the tubing hanger spool. Difficulties are typically encountered when landing the tubing hanger in the tubing spool and ensuring the tubing hanger is properly oriented so that axial passages in the tubing hanger and production are aligned.

SUMMARY OF THE INVENTION

Disclosed herein is an example of a subsea wellhead assembly. In an example embodiment the subsea wellhead assembly includes a wellhead assembly with sidewalls and that further has a production tree, a wellhead housing, a main bore axially extending through the production tree and the wellhead housing, an orientation adapter axially rotationally within the main bore and that is selectively landed in the main bore. Also included is a key that protrudes radially outward from the orientation assembly, a communication passage formed in a sidewall of the production tree, a communication port in the orientation adapter in communication with a control line disposed within the main bore. The wellhead assembly also includes a profile on an inner surface of the main bore in interference with the key when the orientation adapter is landed in the main bore, and that is strategically formed to orient the orientation adapter in a designated azimuth so that the communication port registers with the communication passage. In an example, the profile projects radially inward and follows a helically shaped path along the inner surface of the main bore. Further optionally included is a tubing hanger that lands in the main bore and rotationally couples to the orientation. In this example, a lower end of the tubing hanger includes a groove on an outer surface that defines an upward facing shoulder, the lower end of the tubing hanger inserts into a cavity on an upper surface of the orientation adapter, a groove is formed in the cavity to define a downward facing shoulder, and the downward facing shoulder lands on the upward facing shoulder so that the orientation adapter is supported by the tubing hanger. Optionally, the assembly further includes production tubing depending from the tubing hanger that projects through a bore in the orientation adapter, an annular adapter block mounted on the production tubing that is spaced away from a lower end of the orientation adapter and that is connected to the control line. The control line can be flexible tubing that depends from an end of the communication port and that selectively circumscribes production tubing in the main bore when the orientation adapter is in the designated azimuth; and can carry a fluid, an electrical line, or combinations thereof.

Also disclosed is a subsea wellhead assembly that is made up of a wellhead housing set over a wellbore, a production tree set on the wellhead housing, a main bore that extends axially through the wellhead housing and production tree, a profile in the main bore that projects radially inward and follows a helical path along an inner surface of the main bore, a communication passage formed through a sidewall of the production tree, and a tubing hanger assembly. The tubing hanger assembly includes a tubing hanger and an orientation adapter rotatably mounted on a lower end of the tubing hanger. A communication passage is included in a sidewall of the production tree, and a communication path is radially formed through the orientation adapter. A key is on an outer surface of the orientation adapter that engages the profile, and that is strategically located so that when the tubing hanger assembly is landed in the main bore, interference between the key and the helical profile rotates the orientation adapter into a position to register the communication passage and communication path. The profile can be set within the production tree. A control line can be included that has an end connected to a lower end of the orientation adapter and is in communication with a downhole component, so that when the communication passage and communication path are in communication, the downhole component is controllable from surface. The communication path and communication passage can communicate a fluid, an electrical signal, or both a fluid and an electrical signal. Alternatively included is a control line in communication with the communication path, wherein the control line is flexible tubing that depends from the orientation adapter and that selectively circumscribes production tubing in the main bore when the orientation adapter is in the designated azimuth. The tubing hanger and the orientation adapter can be connected via a tongue and groove coupling.

Another example of a wellhead assembly is made up of an axially disposed main bore, a sidewall extending from the main bore and radially outward to an outer surface, a passage through the sidewall, an orientation adapter that selectively lands within the main bore, a communication path that intersects the orientation adapter, a profile in the main bore that is in sliding interference with the orientation adapter when the orientation adapter is being landed in the main bore, and that is strategically formed so that the orientation adapter is azimuthally oriented to register the communication path with the passage. Further optionally included is a tubing hanger having a lower end that coaxially inserts into a cavity on the orientation adapter, and wherein the orientation adapter is rotatable with respect to the tubing hanger. The wellhead assembly can further include production tubing depending from the tubing hanger, an annular adapter block mounted around the production tubing, and a control line in communication with the communication path, that depends from the orientation adapter, and has a lower end connecting to the adapter block. Yet further optionally included is a lower housing that depends from a lower end of the orientation adapter and circumscribes the adapter block. Alternatively, the tubing hanger is mounted in a production tree, and production fluid flows through a bore coaxially formed in the tubing hanger and exits the production tree through a production port.

BRIEF DESCRIPTION OF DRAWINGS

Some of the features and benefits of the present invention having been stated, others will become apparent as the description proceeds when taken in conjunction with the accompanying drawings, in which.

Figure 1:
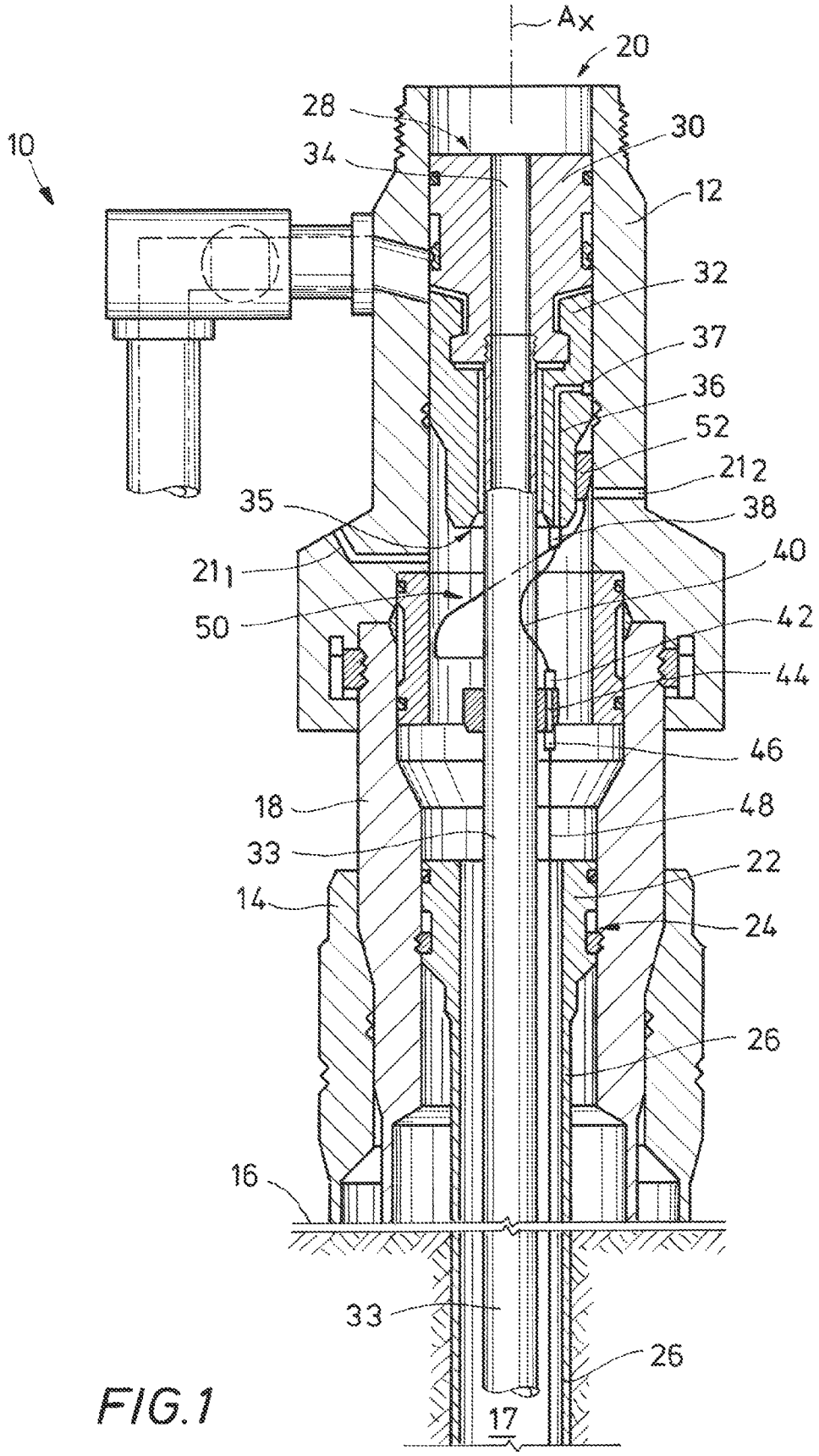
FIG. 1 is a side sectional perspective view of an example embodiment of an wellhead assembly being assembled and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

FIG. 1 illustrates in a side sectional view an example of a wellhead assembly 10 being completed. The wellhead assembly 10 includes a production tree 12 with a low pressure housing 14 shown set on the sea floor 16. A wellbore 17 projects into a formation underneath the wellhead assembly 10. The production tree 12 is mounted onto a high pressure housing 18, which has a lower end inserted within low pressure housing 14. Lower ends of the low and high pressure housings 14, 18 project into the sea floor 16 for supporting the housings 14, 18. A main bore 20 is defined within the inner surfaces of production tree 12 and high pressure housing 18. Communication passages $\mathbf{21}_1$, $\mathbf{21}_2$ are shown formed radially through a sidewall of production tree 12 and each having an end in communication with main bore 20.

A casing hanger 22 is shown landed within the high pressure housing 18 and is coupled therein by virtue of a latching assembly 24, which anchors into an inner surface of main bore 20 within high pressure housing 18. Annular casing 26 depends from a lower end of casing hanger 22 and into wellbore 17. Above casing hanger 22 is a tubing hanger assembly 28 shown being inserted within main bore 20 and illustrating a step of completing wellhead assembly 10. Included within the tubing hanger assembly is an annular tubing hanger 30 with an attached orientation adapter 32 that is rotatably coupled on a lower portion of tubing hanger 30. Production tubing 33 is threaded into a lower end of tubing hanger 30; production tubing 33 has an annulus in fluid communication with an axial bore 34 formed through tubing hanger 30. Axial bore 34 registers with a bore 35 axially formed through orientation adapter 32, production tubing 33 inserts through bore 35. After exiting bore 38, production tubing 33 projects downward within main bore 20 and into wellbore 17.

A communication path 36 is illustrated formed through orientation adapter 32; which in this example is a passage or bore that extends through orientation adapter 32 radially outward from bore 35, and extends generally parallel with an axis $A_X$ of wellhead assembly 10. Communication path 36 transitions from an axial direction to a radially outward one, and terminates at an outer surface of orientation adapter 32. An optional connector 37 is provided at the outer surface of orientation adapter 32 at the terminal point of communication path 36. A connector 38 is shown at an end of communication path 36 opposite from connector 37, wherein connector 38 provides a means for connecting a flexible tubing 40 which is shown depending from a lower end of orientation adapter 32. Axially downward from connector 38 is connector 42, which connects flexible tubing 40 to an annular adapter block 43. Adapter block 43 is shown circumscribing a portion of production tubing 33. A passage 44 axially extends through adapter block 43 and communicates with a connector 46 on a lower end of adapter block 43. A length of flexible tubing 48 (that optionally can be rigid) is shown attached to connector 46 and couples to a downhole component 49 (FIG. 2) which can be used for controlling operations within wellbore 17. Examples of a downhole component 49 include a control valve which can open and close for regulating fluid flow within wellbore 17.

A profile 50 is schematically illustrated within the inner surface of main bore 20 and follows a helical path along the inner surface of main bore 20. As will be described in more detail below, a key 52 shown on an outer surface of orientation adapter 32 engages profile 50 as tubing assembly 28 is being landed within wellhead assembly 10. While tubing hanger assembly 28 is being inserted into wellhead assembly 10, key 52 comes into contact with profile 50 and slides along its path. By directing key 52 along the helical path of profile 50, orientation adapter 32 is rotated when the tubing hanger assembly 28 is lowered within wellhead assembly 10.

Figure 2:
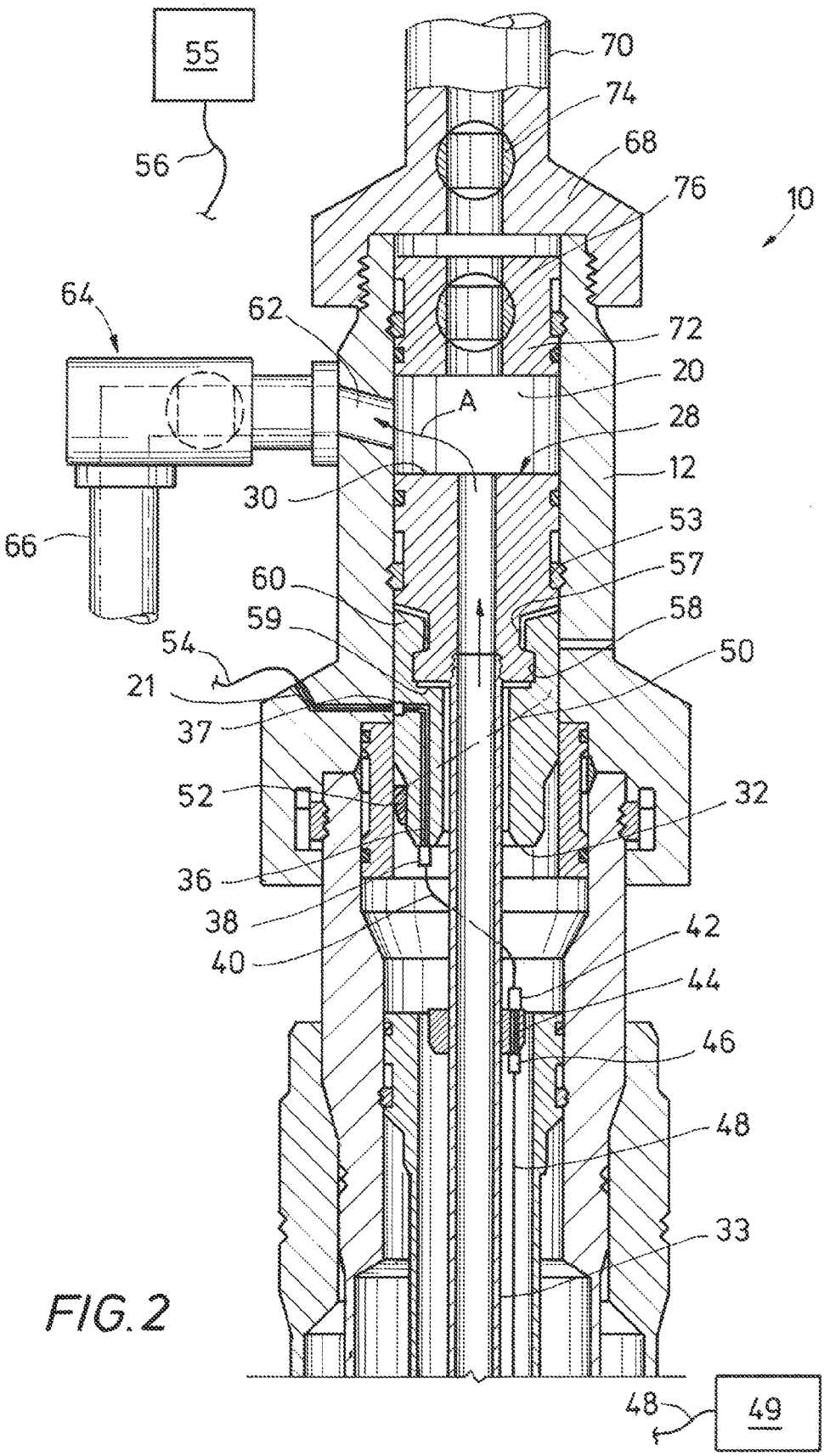
FIG. 2 is a side sectional perspective view of an example embodiment of the wellhead assembly of FIG. 1 after assembly and in accordance with the present invention.

Referring now to FIG. 2, an example of a fully assembled wellhead assembly 10 is shown in side sectional view and with the tubing hanger assembly 28 landed within the production tree 12. Latching dogs 53 are on an outer surface of tubing hanger 30 that engage the inner surface of main bore 20 for coupling tubing hanger assembly 28 within main bore 20. Further illustrated in the example of FIG. 2 is a line 54 that attaches to a communication passage 21 at an outer surface of production tree 12. Optionally, line 54 can be in communication with controller 55 via line 56. Examples of control can involve directing hydraulic fluid and/or electrical signals from controller 55 via lines 54, 56. In examples where the medium within lines 54, 56 is a fluid, connector 37 can be what is commonly referred to as a spheri-seal. In situations where the signal is being communicated via lines 54, 56 are electrical, the connector 37 can be a wet connect. Optionally, multiple forms of signal or control can be provided through production tree 12 via multiple communication passages 21 and various connectors 37. Thus, control within wellbore 12 can be a combination of hydraulics and/or electrical signals, and the combination of lines 54, 56, 40 and connectors 37, 46, 42 can provide the control from surface into wellbore 17. Controller 55 can optionally be on land, or on an offshore rig above the sea surface disposed over wellbore 17.

In the example of FIG. 2, tubing hanger 30 is coupled to orientation adapter 32 via a tongue and groove type connection. More specifically, the lower end of tubing hanger 30 has a groove 57 formed along its outer surface which defines a flange 58 on the lower end of tubing hanger 30. An upward facing surface or shoulder is formed within groove 57 on flange 58. Bore 35 of orientation adapter 32 has a diameter that transitions radially outward to accommodate insertion of the lower end of tubing hanger 30. Where the bore 35 projects radially outward, an upward facing shoulder is defined which provides a contact point for the lower terminal end of tubing hanger 30. Spaced axially upward from shoulder, the diameter of bore 35 projects radially inward to create a flange 60 that is shown projecting within cavity 57 of tubing hanger 30. The profiled respective lower and upper portions of tubing hanger 30 and orientation adapter 32 create surfaces that support orientation adapter 32 on the lower end of tubing hanger 30. Moreover, this profiling allows for the free rotation of orientation adapter 32 with respect to tubing hanger 30 so that the orientation adapter 32 can rotate as needed when key 52 comes into interfering contact with profile 50. Furthermore, the location and orientation of key 52 and profile 50 are strategically disposed so that when tubing assembly 28 is landed within wellhead assembly 10, the communication path 36 comes into full registration with communication passage 21 so that fluid communication as described above between controller 55 and downhole component 49 is automatically created. Additionally, the communication is not limited to fluid communication, but can also provide electrical or any other type of communication between the controller 55 and downhole component 49. In an example, the tubing string 33 remain rotationally stationary within the production tree 12 during assembly of the wellhead assembly 10.

Further illustrated in the example of FIG. 2 is a production port 62 that is formed through a sidewall of production tree 12. Arrow A illustrates an example of fluid flow path from within production tubing 33, into main bore 20, and radially outward through production port 62. After exiting port 62, fluid is directed into a manifold 64 shown attached to an outer surface of production tree 12. A production flow line 66, which connects to manifold 64, may be provided for porting produced fluids for processing. An optional tree adapter 68 is shown mounted on an upper end of production tree 12, which may be used for connecting wellhead assembly 10 to a riser 70. In an example, riser 70 extends up to sea surface and allow access to within wellhead assembly 10 from sea surface. A tree cap 72 is further provided in the example of FIG. 2 and inserted within production tree 12 inside main bore 20. Valves 74, 76 are disposed respectively in tree adapter 68 and tree cap 72, which can be used for allowing selective access to within main bore 20 from above wellhead assembly 10.

Figure 3:
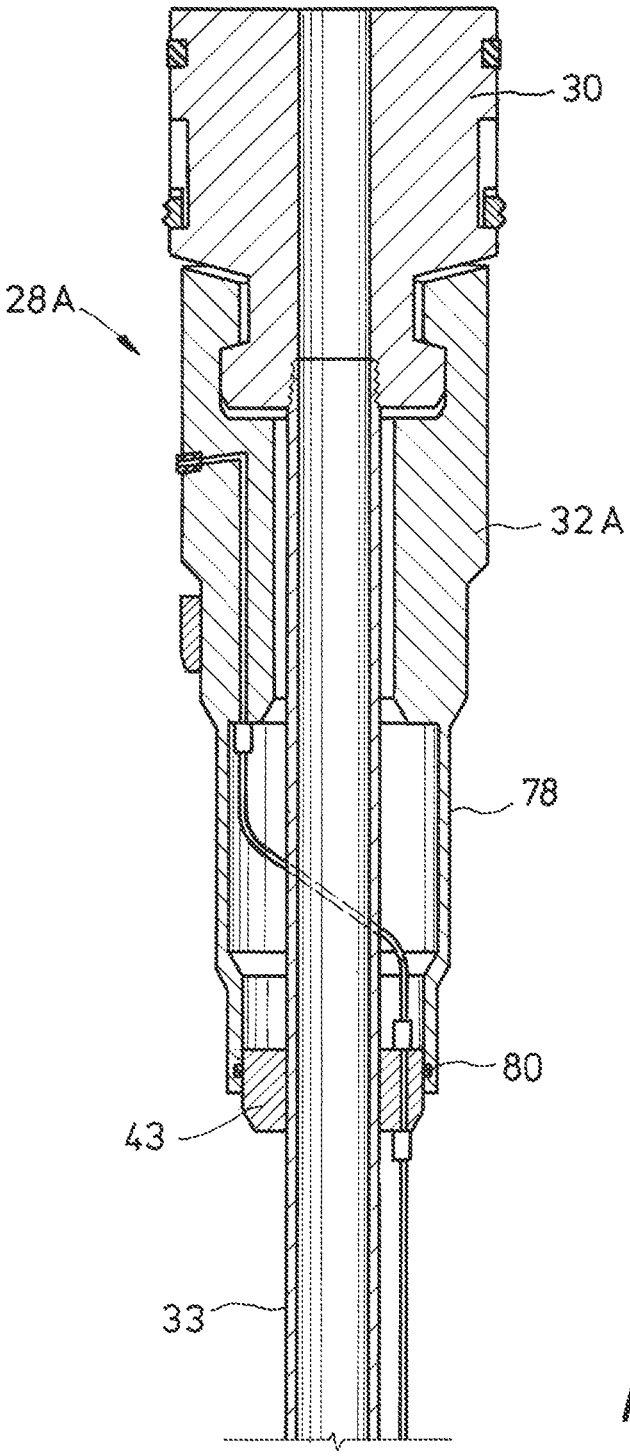
FIG. 3 is a side sectional view of a lower end of a tubing hanger assembly with lower housing in accordance with the present invention.

Referring now to FIG. 3, an optional example of tubing hanger assembly 28 is shown in a side sectional view. In this example, tubing hanger 30 is rotationally coupled to an optional embodiment of orientation adapter 32A, wherein 32A further includes a lower housing 78 that depends downward from its lower end. Housing 78 is a generally hollow element which has a lower end set adjacent an outer circumference of adapter block 43 thereby circumscribing adapter block 43. Seals 80 may optionally be provided at the interface between adapter block 43 and inner surface of housing 78 for sealing the space defined within housing 78 and around production tubing 33.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellhead assembly having sidewalls and comprising:
- a production tree;
- a wellhead housing;
- a main bore axially extending through the production tree and the wellhead housing;
- an orientation adapter axially rotatable within the main bore and that is selectively landed in the main bore;
- a key that protrudes radially outward from the orientation adapter;
- a communication passage formed in a sidewall of the production tree;
- a communication port in the orientation adapter in communication with a control line disposed within the main bore;
- a profile on an inner surface of the main bore in interference with the key when the orientation adapter is landed in the main bore, and that is strategically formed to orient the orientation adapter in a designated azimuth so that the communication port registers with the communication passage; and
- a tubing hanger that lands in the main bore, and wherein the orientation adapter rotationally couples with the tubing hanger, wherein a lower end of the tubing hanger comprises a groove on an outer surface that defines an upward facing shoulder, wherein the lower end of the tubing hanger inserts into a cavity on an upper surface of the orientation adapter, wherein a groove is formed in the cavity to define a downward facing shoulder, and wherein the downward facing shoulder lands on the upward facing shoulder so that the orientation adapter is supported by the tubing hanger.

2. The wellhead assembly of claim 1, wherein the profile projects radially inward and follows a helically shaped path along the inner surface of the main bore.

3. The wellhead assembly of claim 1, further comprising production tubing depending from the tubing hanger that projects through a bore in the orientation adapter, an annular adapter block mounted on the production tubing that is spaced away from a lower end of the orientation adapter and that is connected to the control line.

4. The wellhead assembly of claim 1, wherein the control line comprises flexible tubing that depends from an end of the communication port and that selectively circumscribes production tubing in the main bore when the orientation adapter is in the designated azimuth.

5. The wellhead assembly of claim 1, wherein the control line carries a medium selected from the group consisting of a fluid, an electrical line, and combinations thereof.

6. A subsea wellhead assembly comprising:

a wellhead housing set over a wellbore;

a production tree set on the wellhead housing;

a main bore that extends axially through the wellhead housing and production tree;

a profile in the main bore that projects radially inward and follows a helical path along an inner surface of the main bore;

a communication passage formed through a sidewall of the production tree;

a tubing hanger assembly comprising a tubing hanger and an orientation adapter rotatably mounted on a lower end of the tubing hanger, wherein a lower end of the tubing hanger comprises a groove on an outer surface that defines an upward facing shoulder, wherein the lower end of the tubing hanger inserts into a cavity on an upper surface of the orientation adapter, wherein a groove is formed in the cavity to define a downward facing shoulder, and wherein the downward facing shoulder lands on the upward facing shoulder so that the orientation adapter is supported by the tubing hanger;

a communication path radially formed through the orientation adapter; and a key on an outer surface of the orientation adapter that engages the profile, and that is strategically located so that when the tubing hanger assembly is landed in the main bore, interference between the key and the helical profile rotates the orientation adapter into a position to register the communication passage and communication path.

7. The wellhead assembly of claim 6, wherein the profile is set within the production tree.

8. The wellhead assembly of claim 6, further comprising a control line that has an end connected to a lower end of the orientation adapter and is in communication with a downhole component, so that when the communication passage and communication path are in communication, the downhole component is controllable from surface.

9. The wellhead assembly of claim 6, wherein the communication path and communication passage communicate a fluid, an electrical signal, or both a fluid and an electrical signal.

10. The wellhead assembly of claim 6, further comprising a control line in communication with the communication path, wherein the control line comprises flexible tubing that depends from the orientation adapter and that selectively circumscribes production tubing in the main bore when the orientation adapter is in the designated azimuth.

11. A wellhead assembly comprising:

an axially disposed main bore;

a sidewall extending from the main bore and radially outward to an outer surface;

a passage through the sidewall;

an orientation adapter that selectively lands within the main bore;

a communication path that intersects the orientation adapter;

a profile in the main bore that is in sliding interference with the orientation adapter when the orientation adapter is being landed in the main bore, and that is strategically formed so that the orientation adapter is azimuthally oriented to register the communication path with the passage;

a tubing hanger having a lower end that coaxially inserts into a cavity on the orientation adapter, and wherein the orientation adapter is rotatable with respect to the tubing hanger;

production tubing depending from the tubing hanger, an annular adapter block mounted around the production tubing, and a control line in communication with the communication path, that depends from the orientation adapter, and has a lower end connecting to the adapter block; and a lower housing that depends from a lower end of the orientation adapter and circumscribes the adapter block.

12. The wellhead assembly of claim 11, wherein the tubing hanger is mounted in a production tree, and production fluid flows through a bore coaxially formed in the tubing hanger and exits the production tree through a production port.

* * * * *